US006710585B2

(12) United States Patent
Schmitt et al.

(10) Patent No.: US 6,710,585 B2
(45) Date of Patent: Mar. 23, 2004

(54) LINEAR REGULATOR WITH CHARGE PUMP

(75) Inventors: Stefan Schmitt, Furth (DE); Roland Bittner, Nurnberg (DE)

(73) Assignee: Semikron Elektronik GmbH, Nuremburg (DE)

( * ) Notice: Subject to any disclaimer, the term of this patent is extended or adjusted under 35 U.S.C. 154(b) by 0 days.

(21) Appl. No.: 10/242,286

(22) Filed: Sep. 11, 2002

(65) Prior Publication Data

US 2003/0067288 A1 Apr. 10, 2003

(51) Int. Cl.[7] ..... G05F 1/40
(52) U.S. Cl. ..... 323/281; 323/273; 323/266
(58) Field of Search ..... 323/281, 273, 323/274, 266

(56) References Cited

U.S. PATENT DOCUMENTS 6,157,176 A * 12/2000 Pulvirenti et al. ..... 323/266
6,617,832 B1 * 9/2003 Kobayashi ..... 323/266

* cited by examiner

*Primary Examiner*—Shawn Riley
(74) *Attorney, Agent, or Firm*—Darby & Darby

(57) ABSTRACT

A voltage-regulating circuit uses a combination of a longitudinal regulator circuit with a switched charge-pumping circuit. The longitudinal regulator circuit contains a transistor, a first resistor, and a zener diode. The charge-pumping circuit has a second resistor, a capacitor and a switched voltage source lying in series between the output potential of the voltage-regulating circuit and a chassis ground potential. The anode of a diode is connected to a point between the second resistor and the capacitor, while the cathode of the diode is connected to the controlling signal input of the transistor.

7 Claims, 3 Drawing Sheets

LINEAR REGULATOR WITH CHARGE PUMP

RELATED APPLICATION

This application claims priority from German Patent Application DE 101 44 591.1, filed Sep. 11, 2001, which is incorporated by reference in its entirety.

BACKGROUND OF THE INVENTION

The invention relates to a circuit arrangement for regulating a voltage and to generate, from a given input voltage, an output voltage that does not exceed a given maximum. The circuit arrangements of interest in the present context find application in cases where any kind of consumer devices require an interruption-free voltage supply and where the input voltage of the circuit arrangement may be higher than the maximum permissible voltage of the consumer devices. For example, circuit arrangements of this kind are used to limit the rise in voltage during the charging process in battery-powered systems or when the power is withdrawn through an inverter, or during the so-called load dump when power is supplied by a generator.

DESCRIPTION OF THE RELATED ART

The state of the art includes the following circuit arrangements, some of which are described in "Halbleiter Schaltungstechnik", Tietze, Schenk, ISBN 3-540-19475-4.

In principle, one has to distinguish between two operating states of the circuit arrangement:

1. The magnitude of the supply voltage is lower than the maximum permissible operating voltage of the consumer devices. In this case, no measures need to be taken to regulate the voltage.
2. The magnitude of the supply voltage is higher than the maximum permissible operating voltage of the consumer devices. In this case, the output voltage of the circuit arrangement has to be lower than or equal to the maximum permissible operating voltage of the consumer devices.

One possibility to protect consumer devices from a voltage that is higher than the maximum voltage permissible for the given consumer devices is to temporarily separate the consumer devices from the excessive voltage. During the temporary separation, the consumer devices are supplied with power from an energy-storage device such as an accumulator or a capacitor, to ensure that the devices continue to operate without interruption.

The foregoing solution has the disadvantage that energy-storage devices such as accumulators or capacitors have a limited capacity. Also, if capacitors are used, large charging currents will occur at the time when the circuit is turned on. Accumulators, on the other hand, require the addition of a charger device. Therefore, the concept of separating the consumer devices from the supply voltage is feasible only for consumer devices with low power consumption and/or if the periods when the supply voltage exceeds the limit are relatively short. However, even if these conditions are met, the arrangements just described still suffer from the main drawback that they involve circuits of considerable complexity and require a considerable amount of space.

Another possibility to protect consumer devices from excessive supply voltage levels is to take appropriate measures already in the design stage of the consumer devices, so that they will be able to tolerate the maximum possible excess voltage. This means that all components of the consumer device circuits have to be selected or designed to withstand the maximum anticipated voltage level, which in most cases entails a higher cost of the device as well as higher power losses, for example because semiconductor elements for higher voltages as a rule have a poorer conductance. For these reasons, the last mentioned solution is feasible only if the maximum levels of the over-voltages exceed the normal operating voltage by no more than a small amount.

A third possibility is offered by so-called clamping circuits, i.e., special components such as zener diodes, varistors, or suppressor diodes, which dissipate the energy contained in the difference between the over-voltage and the maximum operating voltage into heat. However, the fact that they are heat generators also represents the main drawback of these devices. The aforementioned components can only absorb a limited amount of dissipated energy and are therefore usable only for short-term and low-energy over-voltages.

As a forth possibility, it is possible to use so-called longitudinal regulator circuits, which are known in the form of discrete circuits as well as integrated circuits. They have the disadvantage that they work with a considerable loss of energy even in an operating state where the input voltage is below the maximum permissible operating voltage of the consumer devices. Even integrated circuits with minimized loss characteristics, so-called low-drop regulators, still have a voltage drop of about 200 mV across the component.

SUMMARY OF THE INVENTION

It is the foregoing and various other drawbacks of this prior art which the present invention seeks to overcome by providing a voltage regulator circuit that works with a minimum amount of energy loss when the input voltage is less than or equal to the maximum permissible operating voltage of the consumer devices, and which is further distinguished by low component cost and low design complexity to achieve the regulating function when the input voltage is higher than the maximum permissible operating voltage of the consumer devices.

The voltage-regulating circuit according to the present invention includes a longitudinal regulator circuit and a charge-pumping circuit. The longitudinal regulator circuit contains a transistor, a resistor, and a zener diode, while the charge-pumping circuit has a resistor, a diode, a capacitor, and a switched voltage source. The resistor, the capacitor, and the switched voltage source of the charge-pumping circuit are connected in series between the output of the transistor of the longitudinal regulator circuit and a reference potential, e.g., chassis ground. The anode of the diode of the charge-pumping circuit is connected to the mid-point between the resistor and the capacitor of the charge-pumping circuit, while the cathode is connected to the controlling signal input of the transistor of the longitudinal regulator circuit.

In an embodiment of the inventive circuit, the transistor of the longitudinal regulator circuit is a bipolar transistor, a MOS-FET (Metal Oxide Semiconductor Field Effect Transistor), or an IGBT (Insulated Gate Bipolar Transistor).

The inventive circuit may further include a switch between the controlling input of the transistor in the longitudinal regulator circuit and the reference potential, so that the circuit can be turned off.

In a further embodiment, the zener diode of the longitudinal regulator circuit can be replaced by a circuit element that is supplied and controlled by a feedback voltage that is tapped off a voltage divider from the output of the voltage-regulating circuit.

As described above in connection with the prior art, one has to distinguish again between two operating states:

1. The magnitude of the supply voltage is lower than the maximum permissible operating voltage of the consumer devices. In this case, no measures need to be taken to regulate the voltage. The transistor of the longitudinal regulator circuit is therefore not being operated as a regulating element, but as a switch that is controlled by the switched charge-pumping circuit. Thus, a power loss occurs only due to a conductance-related loss in the transistor rather than to a loss in the longitudinal regulator circuit. The added design complexity of a charge-pumping circuit is small, given that a clock signal similar to the one provided by the charge-pumping circuit is already available in many applications.
2. The magnitude of the supply voltage is higher than the maximum permissible operating voltage of the consumer devices. In this case, the circuit arrangement according to the invention works like a state-of-the-art longitudinal regulator circuit. The charge-pumping circuit still operates and generates an additional, albeit insignificant, contribution to the power loss. The benefits of the longitudinal regulator circuit are preserved, e.g., it is unnecessary to separate the input voltage, and only the components of the protector circuit have to be designed to tolerate the over-voltage.

BRIEF DESCRIPTION OF THE DRAWINGS

The above and still further objects, features, and advantages of the present invention will become apparent upon consideration of the following detailed description of a specific embodiment thereof, especially when taken in conjunction with the accompanying drawings wherein like reference numerals in the various figures are utilized to designate like components and wherein.

DETAILED DESCRIPTION OF THE PREFERRED EMBODIMENTS

Figure 1:
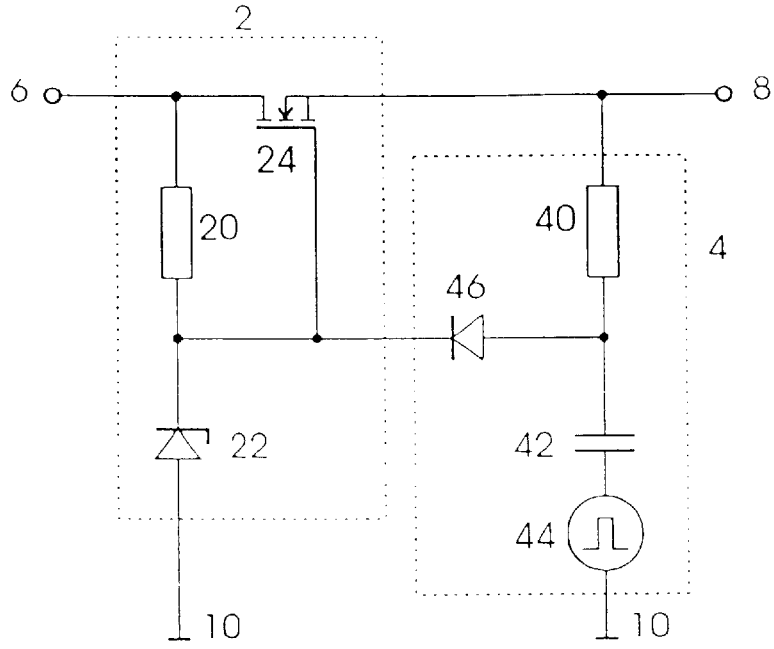
FIG. 1 is a circuit schematic of the combination of a longitudinal regulator circuit with a switched charge-pumping circuit in an embodiment of the present invention.

FIG. 1 illustrates a longitudinal regulator circuit 2 with a switched charge-pumping circuit 4. A typical longitudinal regulator circuit 2, in its most basic form, comprises a transistor 24, a resistor 20, and a zener diode 22. When an input voltage 6 is applied to the circuit, transistor 24 produces a regulated output voltage 8. The regulation is provided by zener diode 22 lying in series with resistor 20 and connecting to the drain of MOS-FET 24. The anode of zener diode 22 is connected to a reference potential (chassis ground) and the cathode is connected to the controlling input (gate) of MOS-FET 24.

According to the invention, the longitudinal regulator circuit is connected to switched charge-pumping circuit 4 which comprises a resistor 40, a diode 46, a capacitor 42, and a switched voltage source 44. In this expanded circuit, the output of transistor 24 is connected to a circuit path leading from output 8 through resistor 40, capacitor 42, and switched voltage source 44 to chassis ground 10. The anode of diode 46 is connected to a point between resistor 40 and capacitor 42 of the aforementioned circuit path, while the cathode of diode 42 is connected to the controlling input (gate) of transistor 24.

The circuit of the present invention operates under two separate states:

In the first state, the magnitude of supply voltage 6 is lower than the maximum permissible operating voltage of the consumer devices. In this case, the regulation of voltage is not necessary. MOS-FET 24 is operated as a switch and, in switch mode, the gate of MOS-FET 24, which represents a capacitor, is charged by means of switched charge-pumping circuit 4. The MOS-FET thus represents a switch in a turned-on state.

The following example will illustrate the advantage of this mode of operation:

| | |
|---|---|
| Maximum input voltage 6 | $U_{in,max}$ = 100 V |
| Maximum output voltage 8 | $U_{out,max}$ = 20 V |
| Desired output voltage 8 | $U_{out}$ = 15 V |
| Output power | $P_{out}$ = 20 W |
| Resistor 20 | R20 = 10 kΩ |
| Output current | $I_{out} = P_{out}/U_{out}$ = 1.33A |

To deliver the desired values of the output quantities of the longitudinal regulator circuit, a voltage $U_{CE}$ that is between a collector and an emitter is approximately equal to a voltage $U_{BE}$ that is between a base and the emitter. Typical values for $U_{BE}$ are approximately 0.6V. From this, one calculates a power loss $P_{LR}$ of the longitudinal regulator circuit:

$$P_{LR}=U_{CE}\cdot I_{out}=0.80W$$

Integrated regulator circuits such as the low-drop regulators mentioned above typically have a voltage drop of 0.2V across the component. Power loss $P_{LD}$ in a low-drop regulator is therefore:

$$P_{LD}=0.2V\cdot 1.33A=0.27W$$

In the circuit arrangement of the present invention, a power loss $P_E$ is determined by two quantities, namely a loss $P_{MF}$ across the MOS-FET and a loss $P_{CP}$ of the charge-pumping circuit. This equation is:

$$P_E=P_{MF}+P_{CP},$$

where $P_{MF}$ stands for the power loss in the MOS-FET which is determined by a resistance $R_{DS,on}$ of the drain source in its conducting state, wherein:

$$R_{DS,on}=0.02\ \Omega, \text{ and thus } P_{MF}=R_{DS,on}\cdot I_{out}^2=0.036W$$

Power loss $P_{CP}$ due to dissipation in the charge-pumping circuit can be calculated by inserting the following typical values into the foregoing equation:

| | |
|---|---|
| Resistor 40 | $R_{40}$ = 10 kΩ |
| Capacitor 42 | $C_{42}$ = 1 nF |
| Voltage source 44 | $U_{44}$ = 10 V |
| Frequency of voltage source 44 | $F_{44}$ = 500 kHz |
| With the results: | $P_{CP} = ½ \cdot C \cdot U^2 \cdot f = 0.025$ W |
| | $P_E = P_{MF} + P_{CP} = 0.061$ W |

As the foregoing example shows, the total amount of the energy loss in the circuit arrangement of the present invention under the assumed operating conditions is more than four times smaller than in state-of-the-art circuits. The results are listed in Table 1 for comparison:

TABLE 1

| | Longitudinal regulator circuit (discrete) | Low-drop IC | Circuit according to the invention |
|---|---|---|---|
| Power loss | 0.80 W | 0.27 W | 0.061 W |
| Loss in % of output power (15 W) | 4.00% | 1.35% | 0.31% |

In the second state, if the magnitude of the supply voltage is higher than the maximum permissible operating voltage of the consumer devices, the circuit arrangement according to the invention works like a state-of-the-art longitudinal regulator circuit. The charge-pumping circuit still operates and generates an additional, albeit insignificant, contribution to the power loss as described above.

Figure 2:
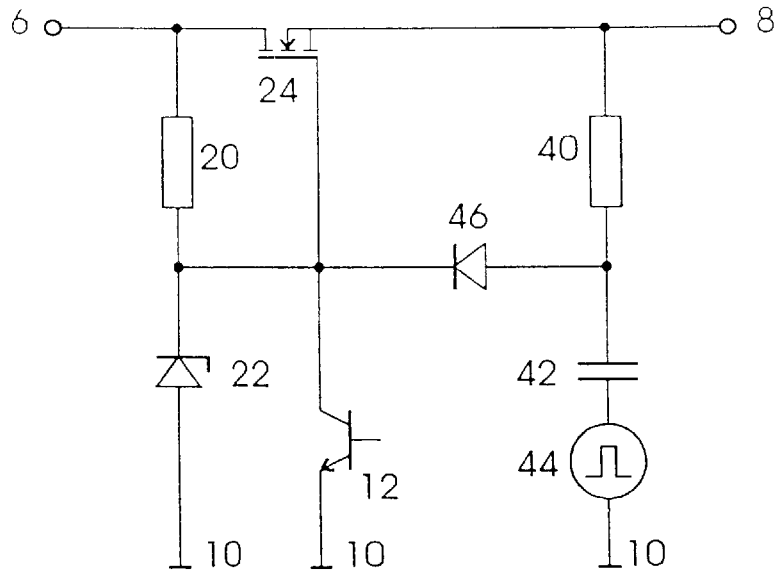
FIG. 2 is a circuit schematic of a second embodiment of the present invention in which the circuit of FIG. 1 is expanded.

FIG. 2 shows an embodiment of the of the present invention that is identical with the circuit of FIG. 1, except for the addition of a switch, e.g., in the form of a transistor 12, which allows output voltage 8 to be switched off. To perform the switching function, the collector of transistor 12 is connected to the gate of MOS-FET 24.

Figure 3:
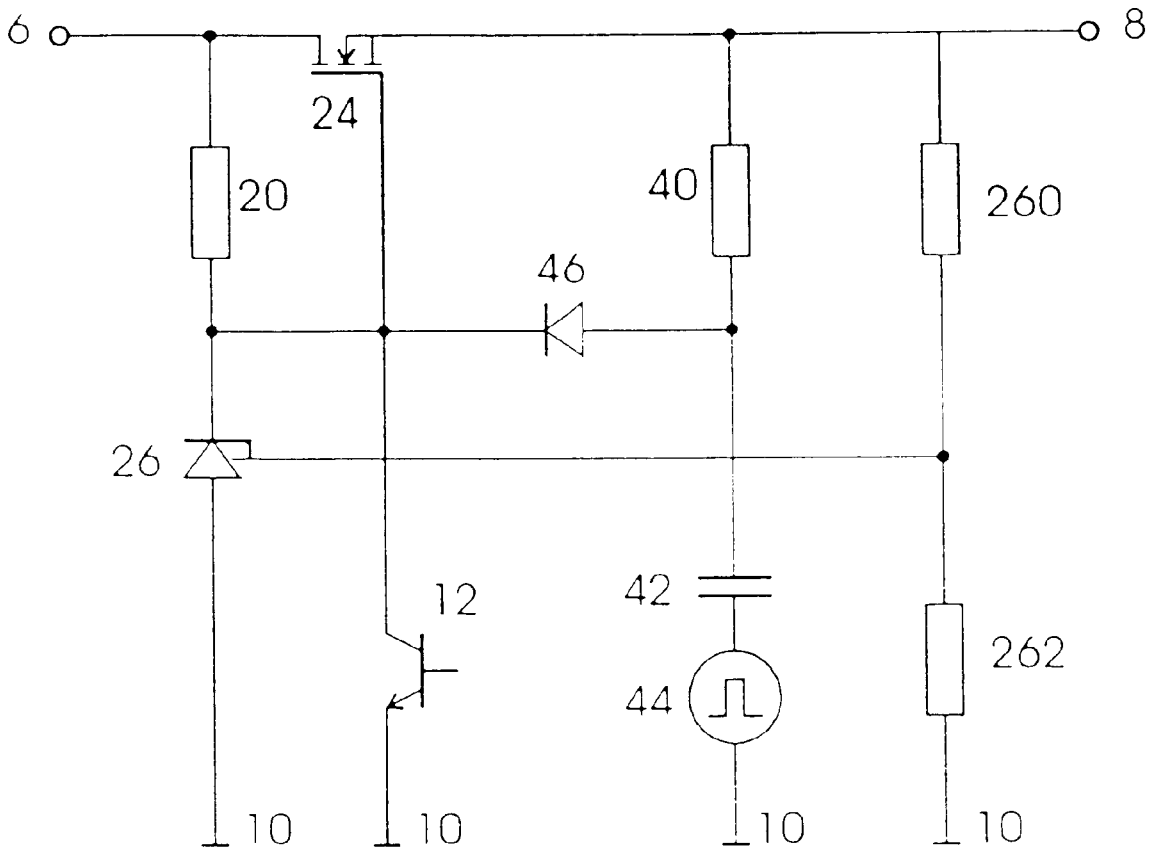
FIG. 3 is a circuit schematic of a third embodiment of the present invention that is a variation of the circuit of FIG. 2.

FIG. 3 shows a variation of the circuit arrangement of the present invention as shown in FIG. 2. In place of a zener diode 22, a circuit component 26 with a control input (e.g., TL431 Adjustable Precision Shunt Regulator) is used to control the longitudinal regulator circuit. The required feedback input voltage to component 26 is tapped off a voltage divider with resistors 260 and 262.

Figure 4:
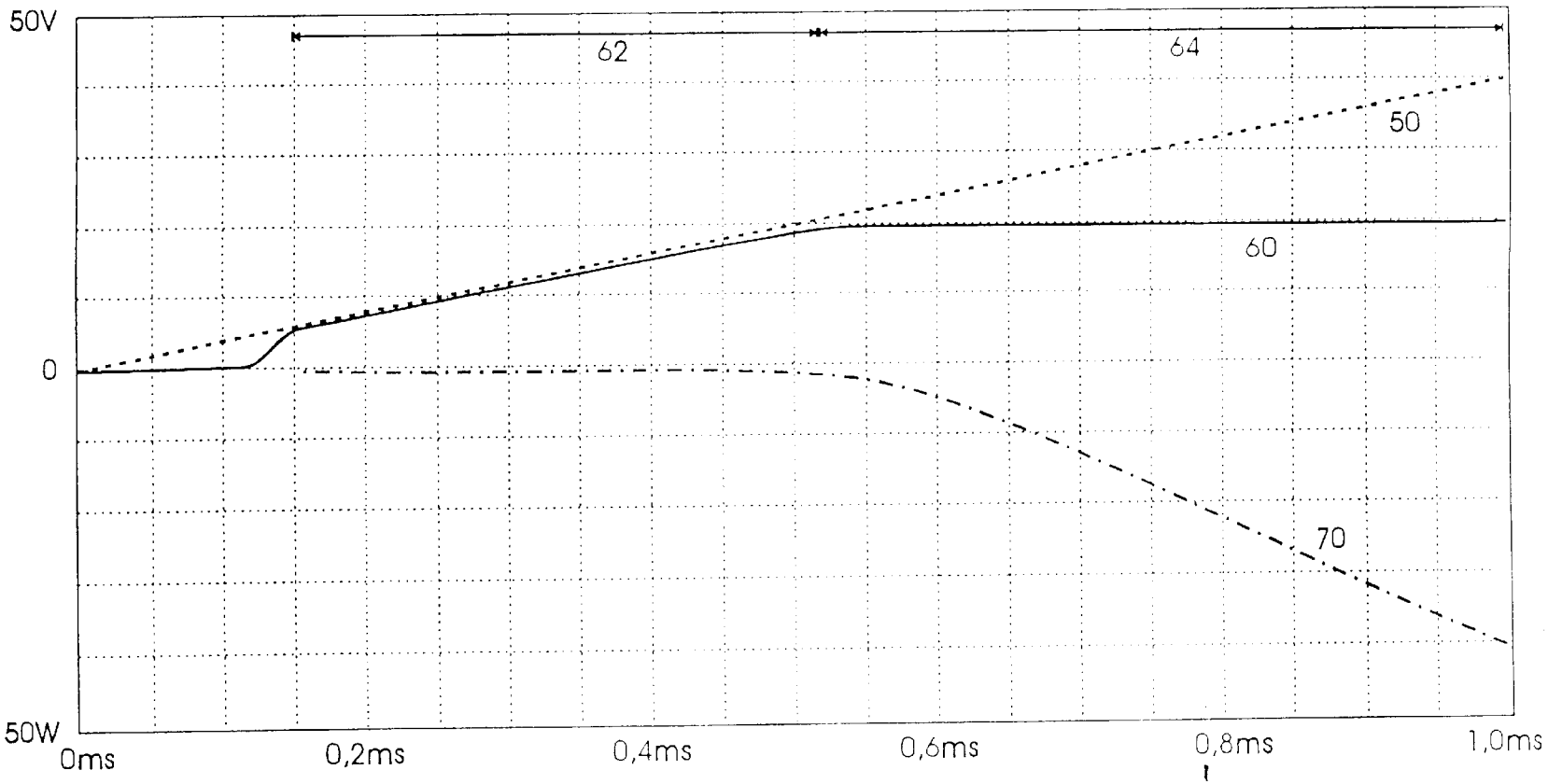
FIG. 4 represents a time graph to illustrate a hypothetical operating situation of the circuit arrangement of the present invention.

FIG. 4 represents a time graph to illustrate how the inventive circuit would behave in a hypothetical operating situation. In this example, input voltage 50 is assumed to increase linearly as a function of time. Curve 60 represents the output voltage of the inventive circuit arrangement and is limited to a maximum permissible output voltage of 20V. Curve 70 represents the power that is lost to dissipation in the inventive circuit arrangement. Range 62 demarcates the portion of the working range of the inventive circuit where the supplied input voltage is lower than the maximum permissible operating voltage of the consumer devices. Within range 62, the time profile of output voltage 60 closely follows that of input voltage 50, with a minimal amount of power loss 70. Range 64 demarcates the portion of the working range of the inventive circuit where the supplied input voltage is higher than the maximum permissible operating voltage of the consumer devices. In this case, the inventive circuit arrangement functions in a way that is analogous to a state-of-the-art longitudinal regulator circuit, and the amount of power lost to dissipation is nearly the same for either kind of circuit.

Thus, while there have been shown, described and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicted by the scope of the claims appended hereto.

What is claimed is:

1. A circuit arrangement for generating a regulated output voltage from a supplied input voltage, said circuit arrangement comprising:

a longitudinal regulator circuit comprising:
- a transistor comprising a controlling signal input;
- a first resistor; and
- a voltage reference element; and a charge-pumping circuit comprising:
- a second resistor;
- a diode comprising an anode and a cathode;
- a capacitor; and
- a switched voltage source;
- the second resistor, the capacitor, and the switched voltage source are connected in series between said output voltage and a reference potential;
- the anode is connected to a point between the second resistor and the capacitor; and
- the cathode is connected to the controlling signal input.

2. The circuit arrangement of claim 1, wherein the voltage reference element comprises a zener diode.

3. The circuit arrangement of claim 1, wherein the transistor comprises one of a bipolar transistor, a metal oxide semiconductor field effect transistor, and an insulated gate bipolar transistor.

4. The circuit arrangement of claim 1, further comprising:

a switching element connected to the controlling signal input and to the reference potential, wherein said switching element is operable to switch said regulated output voltage off.

5. The circuit arrangement of claim 1, wherein the voltage reference element comprises a feedback control input connected to a tap-off point of a voltage divider disposed between the output voltage and the reference potential.

6. A method for generating a regulated output voltage from a supplied input voltage comprising:

providing a circuit arrangement comprising:
- a longitudinal regulator circuit comprising:
  - a transistor comprising a controlling signal input;
  - a first resistor; and
  - a voltage reference element; and a charge-pumping circuit comprising:
- a second resistor;
- a diode comprising an anode and a cathode;
- a capacitor; and
- a switched voltage source;

the second resistor, the capacitor, and the switched voltage source are connected in series between said output voltage and a reference potential;

the anode is connected to a point between the second resistor and the capacitor; and the cathode is connected to the controlling signal input;

supplying an input voltage to the longitudinal regulator circuit;

comparing the input voltage to a predetermined maximum input voltage;

charging the transistor using the charge pumping circuit when the input voltage is lower than the predetermined maximum input voltage whereby the transistor is switched on;

minimizing the regulation action of the longitudinal regulator circuit when the transistor is switched on, whereby power loss is reduced; and maximizing the regulation action of the longitudinal regulator circuit when the transistor is switched off whereby necessary regulation is performed.

7. A method as in claim 6, further comprising:

providing a switching element connected to said controlling signal input and to the reference potential, wherein said switching element is operable to switch said regulated output voltage off.

* * * * *

UNITED STATES PATENT AND TRADEMARK OFFICE

CERTIFICATE OF CORRECTION

PATENT NO. : 6,710,585 B2
DATED : March 23, 2004
INVENTOR(S) : Stefan Schmitt

It is certified that error appears in the above-identified patent and that said Letters Patent is hereby corrected as shown below:

Title page,
Item [54], Title, delete "LINEAR REGULATOR WITH CHARGE PUMP" and substitute -- CIRCUIT ARRANGEMENT FOR REGULATING A VOLTAGE --.
Insert Item:
-- [30] Foreign Application Priority Data
German Application No. 101 44 591.1 filed September 11, 2001 --.

Signed and Sealed this

Twenty-fourth Day of August, 2004

JON W. DUDAS
*Director of the United States Patent and Trademark Office*